United States Patent [19]

Grayson

[11] Patent Number: 4,854,257

[45] Date of Patent: Aug. 8, 1989

[54] YACHT TENDER/BOARDING VESSEL

[76] Inventor: James L. Grayson, 1211 S. Washington Ave., Glendora, Calif. 91740

[21] Appl. No.: 182,405

[22] Filed: Apr. 18, 1988

[51] Int. Cl.[4] ..... B63B 7/00

[52] U.S. Cl. ..... 114/61; 114/315

[58] Field of Search ..... 441/35, 39, 40, 43, 441/44, 45, 65, 129, 130, 132; 114/61, 357, 363, 315; 440/111

[56] References Cited

U.S. PATENT DOCUMENTS

| | | | |
|---|---|---|---|
| 1,762,451 | 6/1930 | Murphy | 441/45 |
| 2,483,552 | 10/1949 | Lincoln | 114/363 |
| 2,974,331 | 3/1961 | Dize | 441/130 |
| 4,315,475 | 2/1982 | Echols | 114/61 |

*Primary Examiner*—Joseph F. Peters, Jr.
*Assistant Examiner*—Edwin L. Swinehart
*Attorney, Agent, or Firm*—John Holtrichter, Jr.

[57] ABSTRACT

There is herein described an improved boarding device for swimmers, divers, and the like, in the form of an invertible catamaran vessel which serves as a yacht tender in it's upright position and as a boarding device for swimmers in it's inverted position.

7 Claims, 2 Drawing Sheets

Fig. 3.
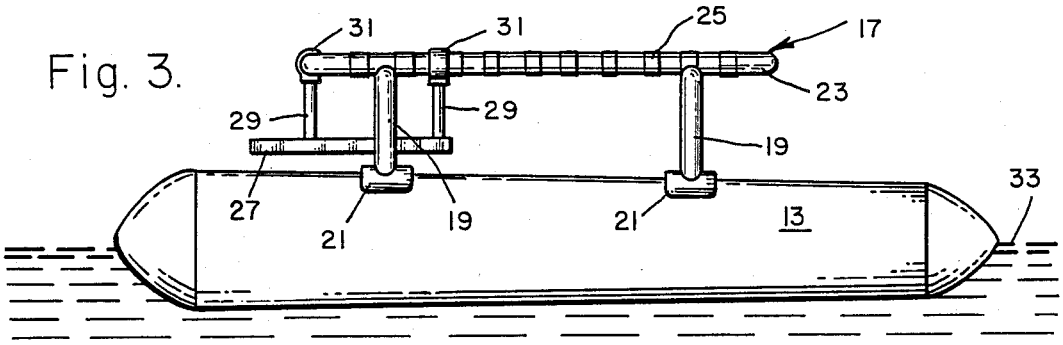
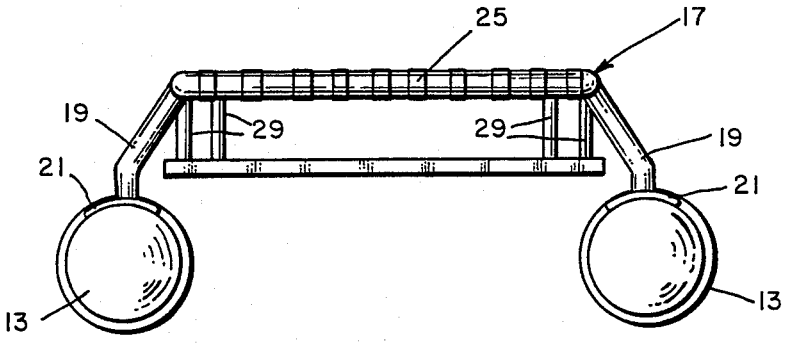
Fig. 4.
Fig. 5.
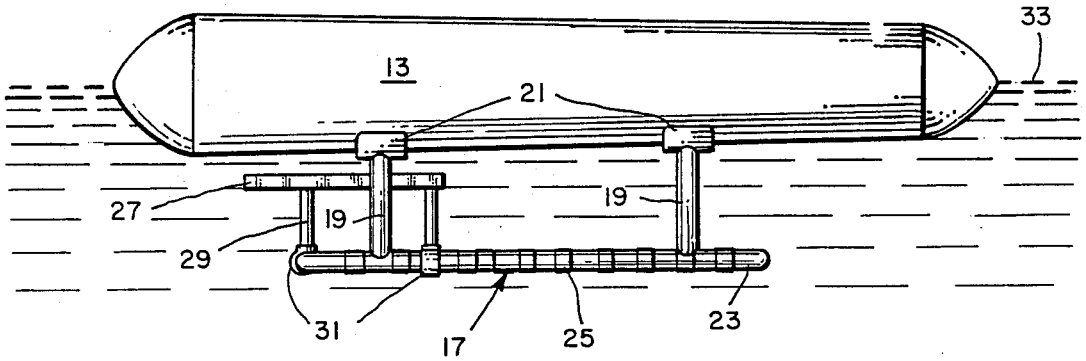

YACHT TENDER/BOARDING VESSEL

TECHNICAL FIELD

This invention relates to the field of flotation devices and more particularly to floating vessels such as yacht tenders for transporting crew and guests to and from shore, and boarding devices for swimmers, divers, and the like, to facilitate boarding by those in the water.

BACKGROUND ART

The invention is an invertible catamaran vessel which, in its upright, yacht tender mode, may be propelled by sail, outboard motor, or by rowing. In its inverted mode, the vessel offers outstanding functional advantages as well as improved safety and convenience for swimmers, SCUBA divers, etc.

Getting on board a boat from the water, in some cases with heavy equipment, can be clumsy, fatiguing, dangerous, and at times impossible to do without assistance. Heretofore, there have been four basic ways of boarding a boat from the water, namely, (1) without aid; (2) swim steps; (3) a ladder; and (4) a ramp.

The use of muscle power alone to get over the side of a boat is by far the most difficult and dangerous of the abovementioned techniques. This method requires a great deal of upper body strength and may not be possible with SCUBA equipment, or when entering a boat with over 12 inches of freeboard. A fatigued swimmer has no means of resting and regaining his or her strength. The time required by this method of exiting the water may leave swimmers vulnerable to attack by sharks or other marine predators.

Swim steps are usually mounted about a foot or more above the water line, and usually extend a maximum of 24 inches beyond the transom. They require balance and upper body strength similar to unaided boarding, and share all of the disadvantages of unaided boarding.

As to the use of ladders, they do offer some improvement over unaided boarding. These devices can also be used in conjunction with a swim step. Ladders still require balance and upper body strength. The receding curvature of most boat hulls further increases the difficulty and danger of this boarding method. The ladder at best provides a very poor resting area for fatigued swimmers. Divers may become very vulnerable to currents since they must remove their fins in order to negotiate the steps of the ladder. Also, ladders are usually unstable, difficult and slow to use.

Diving ramps are used on commercial SCUBA diving boats. They are usually constructed of porous stainless steel and wood platforms approximately 8 feet square. These platforms are attached to the transom of the boat at a point one foot or more above the water line. The opposite end of the platform can be lowered to a point one foot or more below the surface of the water. This method of boarding is easy, rapid, safe, and requires very little upper body strength. The ramp provides a zone of transition for swimmers that functions much like the shallow end of a swimming pool where the swimmer or diver can take advantage of both the buoyancy of the water and the solid structural support of the ramp. Fatigued swimmers can "beach" themselves with very minimal effort and regain their strength until they are able to complete the boarding process. The ramp offers a convenient place for the SCUBA diver to remove bulky equipment while it is partially supported by it's own buoyancy. The speed of this boarding method, along with the structure of the ramp may also provide some protection from marine predators.

The diver's ramp, however, is not without problems. It is expensive, ungainly, and difficult to mount and maintain. Ramps are especially unsuited to boats with narrow transoms, such as sail boats, or boats with protrusions, such as rudders or stern drives. Few boat owners would wish to spoil the aesthetics of their craft with such unsightly structures.

In contradistinction to the prior art, the present invention is an aesthetic and ultra-functional solution to the problems raised with the four traditional boarding methods. The invention fulfills two separate and necessary rolls for the larger boat owner in it's compact package which can be easily disassembled for storage aboard the larger craft. In it's upright position, the invention is an economical, convenient, safe, and super stable yacht tender which can greatly ease the task of transporting passengers from boat to dock, boat to boat, or boat to shore. In it's inverted position, the invention becomes an extraordinary boarding device that functions much like a dive ramp with a submerged safety zone portion, and with the additional advantage that it can be placed to allow access at any point along the primary craft's hull. For example, it can be tethered close to the primary vessel by use of suction cups which attach to the hull of the primary craft, the suction cups being attached to it by short lanyards. Of course, the invention can be positioned completely independently from the primary craft and used as a swimming or divers float.

In reviewing the patented prior art, an improvement in life rafts, particularly of a reversible and collapsible type was found in U.S. Pat. No. 1,104,845. This device includes a valve mechanism for automatically venting the water from the raft in either of its positions. In U.S. Pat. No. 1,973,584, there is described an improvement in rafts for swimming and diving purposes which includes a submersible ladder or ladders suspended below a fabric cover stretched between two elongated tubes or containers (floats). In still another example of the prior art, in U.S. Pat. No. 3,048,859, a raft is shown that includes stabilization means, including a pair of elongated frusto-conical members, which considerably diminishes tilting and practically prevents overturning of the raft under unequally distributed load and under the action of waves. However, in none of the above referenced prior art patents is there described the simple yet advantageous structure of the present invention which includes a submersible safety zone portion in its inverted configuration.

It should thus be clear that the prior art in the subject area of interest generally lacks the utility, helpfulness, simplicity, ruggedness, and safety that is most desired in a combination tender/boarding vessel, and that a vessel which obviates the aforementioned shortcomings would constitute a significant advancement in the art.

SUMMARY OF THE INVENTION

In view of the foregoing factors and conditions characteristic of the prior art, it is a primary object of the present invention to provide a new and improved combination yacht tender and swimmers boarding vessel.

Another object of the present invention is to provide a relatively simple yet effective combination utility boat tender and swimmers boarding vessel.

Still another object of the present invention is to provide a unique combination yacht tender and swimmer's boarding structure which may be easily converted from one mode to the other.

Yet another object of the present invention is to provide an easily convertible water craft that fulfills two separate and necessary rolls for a larger boat owner in it's compact package which can be easily disassembled for storage aboard the larger craft.

In accordance with an embodiment of the present invention, a combination yacht tender/boarding vessel is provided which includes a parallel pair of spaced elongated flotation structures or pontoons, the surface of a body of water in which the pontoons float defining a buoyancy plane between the pontoons, and the upper surface of the pontoons defining an upper plane therebetween. A central platform structure is disposed between the pontoons on the side of the upper plane opposite the buoyancy plane, and superstructure is attached to the pontoons and supports the central platform. Also included is intermediate step structure supported between the central platform structure and the buoyancy plane, whereby the central platform and the intermediate step structure are above the surface of the water when the vessel is in its upright position and at least the central platform is below the surface of the water when in its inverted position.

The features of the present invention which are believed to be novel are set forth with particularity in the appended claims. The present invention, both as to its organization and manner of operation and use, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 3 is a side elevational view of the embodiment of the invention of FIG. 1 in its yacht tender orientation;

FIG. 4 is a front elevational view of the invention in same orientation;

FIG. 5 is a side elevational view of the present invention in its boarding vessel orientation.

DESCRIPTION OF THE PREFERRED EMBODIMENT

Figure 1:
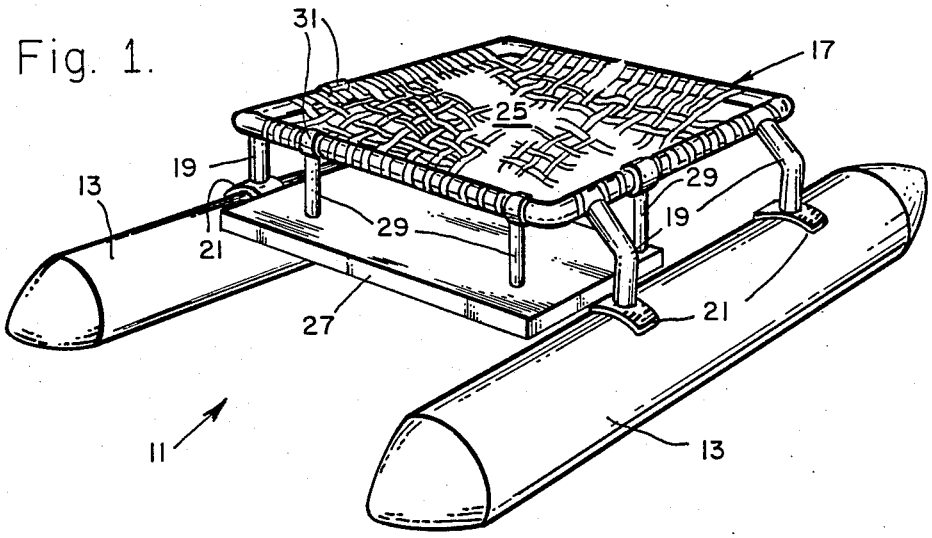
FIG. 1 is a perspective view of the combination yacht tender/boarding vessel according to a presently preferred embodiment of the invention.
Figure 2:
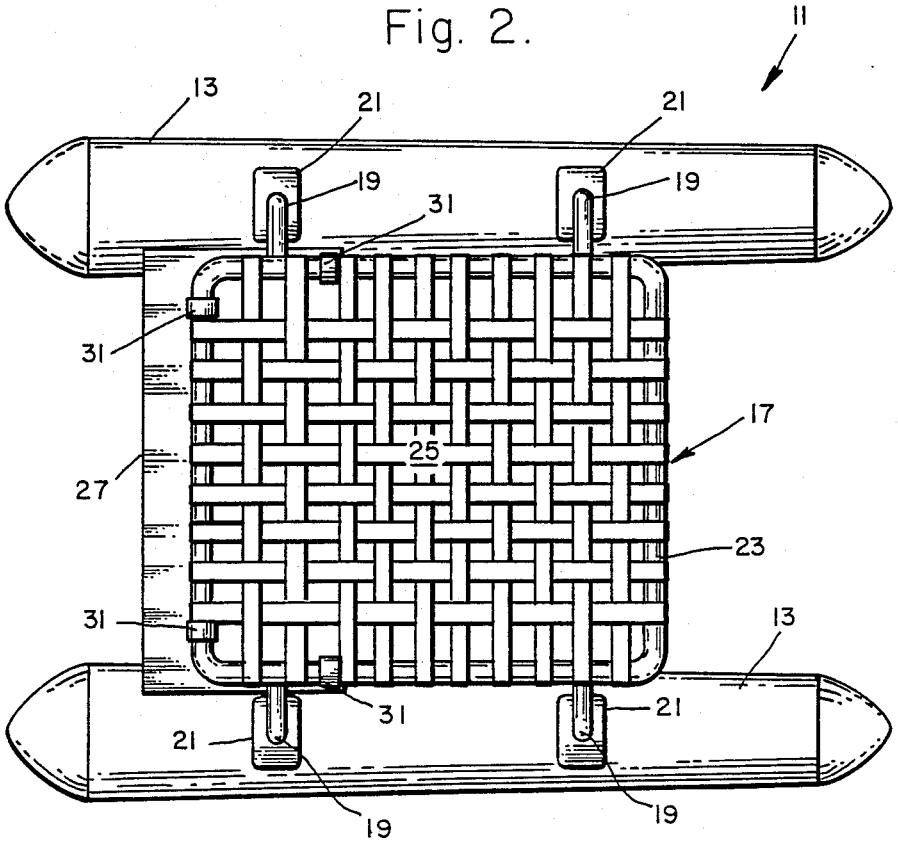
FIG. 2 is a top plan view of the invention seen in FIG. 1.

Referring now to the drawings and more particularly to FIGS. 1–4, there is shown a combination yacht tender/boarding vessel 11 in accordance with an embodiment of the present invention. The vessel 11 includes a pair of elongated flotation structures, such as pontoons 13, which are held in parallel relationship by superstructure 15 and a central platform 17.

The superstructure is here shown to include tubular arm members 19 having a lower curved flange anchor portions 21 attached by any conventional means to the pontoons 13, while the upper portions of the arm members 19 are attached by welding, for example, to the four corners of the central platform 17.

The central platform 17 includes a rectangular tubular member 23 which supports a fabric or fabric-like and preferably water permeable material 25 that is attached to the member 23 by straps or other conventional means. The material 25 may be of unitary construction or comprised of webbing strips, as shown.

Suspended below the central platform 17 is an intermediate step 27. The step is generally rectangular and constructed of wood or of tubular material, and is attached to the central platform by four struts or stanchions 29. The stanchions are attached to the step 27 by any conventional means such as straps 31, for example. If the intermediate step 27 is of tubular construction, it may support webbing strips similar to the material 25 of the central platform or unitarily constructed water permeable material.

In its yacht tender orientation, the pontoons 13 of the vessel 11 float at a level that may be defined as a flotation plane that is coextensive with the water surface 33. In this orientation, both the central platform 17 and the intermediate step 27 (slung below) are above the water surface, while in its inverted or swimmer boarding orientation, both the platform and the step are below the surface of the water, as shown in FIG. 5.

Swimmers or divers can enter the inverted craft by its bow 35 which brings them into a safety zone formed by the central platform 17 that is submerged at a uniform depth of about twelve inches. This safety zone requires little or no strength to enter, and offers both the support of the water's buoyancy and the structural support of the trampoline-like material 25. Also, the safety zone should provide excellent protection from attack by marine predators due to the speed of the exit method and by the wrap-around barrier formed by the vessel's inverted structure. Further while in this zone, a diver can easily remove swim fins, tanks, and other encumbering equipment.

After removing the equipment, the user can then move to a seated position on the intermediate step which should be at a uniform depth below the water surface 33 of about two inches. From this position, a diver can easily pass his equipment up to the primary vessel. The user can then stand on the intermediate step, and with the support of the gunwale of the primary vessel, step onto one of the pontoons or floats and board the attending yacht.

From the foregoing it should be evident that there has herein been described a new and improved combination yacht tender/boarding vessel that is easily converted from one mode to the other, and which provides a unique zone of safety to a swimmer or diver while leaving the water.

Although the invention has been described in detail with respect to presently preferred embodiments of the invention, it should be understood that the invention may be practiced using similar functioning but different elements, under the scope of the appended claims. For example, the floats can be solid or hollow and may be cylindrical, rectangular or of other cross section. Also, the intermediate step 27 may be supported by attachment directly to the superstructure, and the tubular structures may be of a light weight metal such as aluminum, or plastic, and the like, or a light weight solid material such as wood could be substituted if desired. Further, the fabric-like material described above may be canvas, or plastic, or the like.

What is claimed is:

1. A vessel adapted to float on a body of water as a yacht tender with a seat when in an upright position and as a boarding device with a step for swimmers when in an inverted position, comprising:

a parallel pair of spaced elongated flotation structures;

a relatively broad dual function central platform structure disposed between and above said parallel structures and used as a broad yacht tender floor structure when said vessel is in its upright position, and said platform disposed below the water surface and used as a safety zone swimmer's support when in said vessels inverted position;

superstructure attached to said parallel structures and supporting said central platform; and a relatively smaller area intermediate dual function seat/step structure supported below only a portion of said central platform and used as a seat above the surface of the water when said vessel is floating in its upright position and as a swimmer's step when said vessel is in its inverted position.

2. The invertible vessel according to claim 1, wherein both said central platform and said intermediate step are below the surface of the water when said vessel is in its inverted position.

3. The combination yacht tender/boarding vessel according to claim 1, wherein said central platform includes a rectangularly-shaped frame member.

4. The combination yacht tender/boarding vessel according to claim 1, wherein said intermediate step structure is supported by four stanchions attached to said central platform structure.

5. The combination yacht tender/boarding vessel according to claim 3, wherein said central platform also includes a user-support material attached to and supported within said rectangularly-shaped frame member.

6. The combination yacht tender/boarding vessel according to claim 5, wherein said material is a water permeable material.

7. The combination yacht tender/boarding vessel according to claim 6, wherein said material is of webbing construction.

* * * * *